US005907136A

United States Patent [19]

Hongo et al.

[11] Patent Number: 5,907,136

[45] Date of Patent: May 25, 1999

[54] ADJUSTABLE DOUBLE-DECK ELEVATOR

[75] Inventors: Masaharu Hongo, Yamato; Shusaku Shibasaki, Yashio; Masashi Kawarasaki, Narashino; Mitsuo Soekawa, Hino; Yuzo Tada, Urawa; Seiichi Hayashida, Tokyo, all of Japan

[73] Assignee: Otis Elevator Company, Farmington, Conn.

[21] Appl. No.: 09/056,263

[22] Filed: Apr. 7, 1998

[30] Foreign Application Priority Data

Apr. 11, 1997 [JP] Japan ..... 9-093750

[51] Int. Cl.[6] ..... B66B 9/00

[52] U.S. Cl. ..... 187/277; 187/249; 187/902

[58] Field of Search ..... 187/277, 249, 187/902, 414, 285

[56] References Cited

U.S. PATENT DOCUMENTS 1,914,128 6/1933 James et al. ..... 187/249
5,220,981 6/1993 Kahkipuro et al. ..... 187/249

*Primary Examiner*—Robert E. Nappi

[57] ABSTRACT

A double deck elevator (1) includes a linking mechanism (14) disposed between the cars (2, 3).

5 Claims, 6 Drawing Sheets

ADJUSTABLE DOUBLE-DECK ELEVATOR

TECHNICAL FIELD

The present invention is a double deck elevator formed such that the vertical spacing between the upper car chamber and lower car chamber, superimposed vertically into two stories is adjustable.

BACKGROUND OF THE INVENTION

Conventionally, a double deck elevator is made into two stories by vertically superimposing car chambers, as, for example, shown in FIGS. 8 and 9. A double deck elevator has the merits of the transport capacity being large since there are two car chambers at the top and bottom, and being able to economize on the area occupied in the building.

In FIG. 8, two car chambers (102) and (103) are vertically superimposed in one car frame (101) and this car frame (101) is moved vertically by a hoist (not shown in the figure) via a rope. Lower car chamber (103) is formed to move along car frame (101) and is provided with pantograph (104), oil pressure jack (105), oil pressure unit (106), etc., as shown in FIG. 9.

The floor height (space between the floors) of all floors in a building installed with an elevator is not always fixed and may differ depending on the floor. On a particular floor, the floor height differs, with lower car chamber (103) being moved by pressure feeding an operation fluid to oil pressure jack (105) from oil pressure unit (106) so that the space between car chambers (102) and (103) is coordinated with said floor height.

However, in said conventional double deck elevator, one car chamber (102) is not moved, with only the other car chamber (103) being moved in order to match the spacing between vertical two-story car chambers (102) and (103) with the floors of different floor heights, so there was a problem of not being able to quickly execute the adjustment in the spacing between the car chambers (102) and (103).

Also, in order to move the lower car chamber (103), it was necessary to lift the total weight which combined the weight of car chamber (103) and the weight of the passengers riding in this car chamber (103), with oil pressure unit (106). Consequently, oil pressure unit (106) with a great drive force was necessary, so there was a problem of the cost of oil pressure unit (106) as the driving means becoming high. In addition, the overall weight of the car, including car frame (101) and car chambers (102) and (103), became heavy due to the large oil pressure unit (106), so there was the problem of the running cost of the elevator also becoming high.

The present invention aims to make it possible to quickly execute the adjustment in the spacing between the upper and lower car chambers. Also, the aim is to achieve reduction in the cost of the driving means that executes adjustment of said spacing and to reduce the running cost of the elevator.

DISCLOSURE OF THE INVENTION

The present invention provides an adjustable pantograph linking mechanism disposed between upper and lower car chambers collectively supported in a single car frame. The weight of the car chambers balance the forces on the linking mechanism, which is positioned, as required, by a relatively small driving mechanism, as compared to the prior art.

The foregoing and other objects, features and advantages of the present invention will become more apparent in light of the following detailed description of the exemplary embodiments thereof, as illustrated in the accompanying drawings.

BEST MODE FOR CARRYING OUT THE INVENTION

The present invention is structured by providing a car frame that moves vertically by being guided by a main guide rail, secondary guide rails provided in said car frame, an upper car chamber and a lower car chamber that are engaged with said secondary guide rails to move vertically, a driving means that moves either of said upper car chamber and lower car chamber vertically, and a linking mechanism interposed between said upper car chamber and said lower car chamber, which moves said upper car chamber and lower car chamber simultaneously. Also, said linking mechanism is comprised of a first link and a second link in which approximately the center part is rotatably coupled to the car frame, a third link and a fourth link respectively coupled to the top ends of said first link and second link, and a fifth link and a sixth link respectively coupled to the bottom ends of said first link and second link, with the top ends of said third link and fourth link being coupled to the upper car chamber and with the bottom ends of said fifth link and sixth link being coupled to the lower car chamber.

Below, the present invention will be explained based on the figures. FIGS. 1—6 show an application example of a variable double deck elevator related to the present invention.

Figure 1:
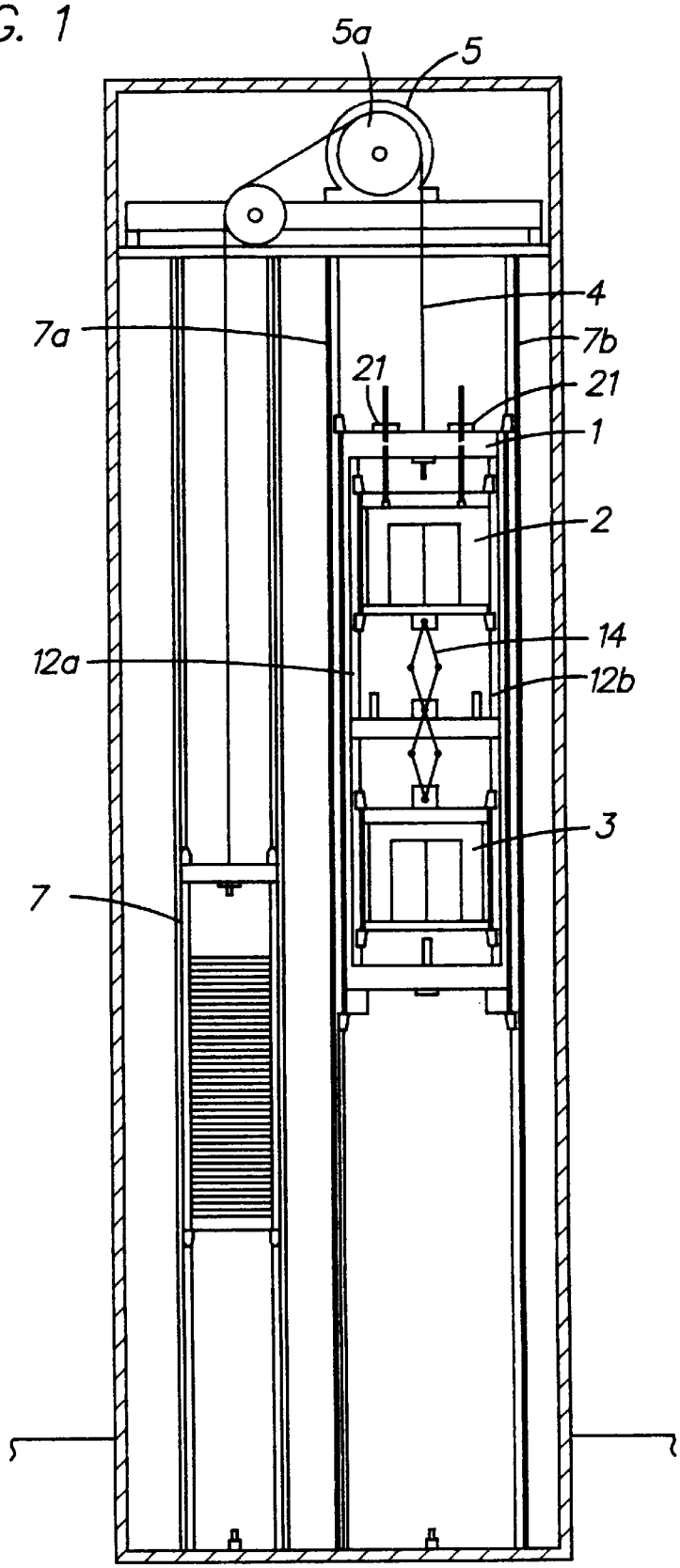
FIG. 1 is a frontal view showing an application example of a variable double deck elevator related to the present invention.

In FIG. 1, (1) represents one car frame; upper car chamber (2) and lower car chamber (3) are vertically arranged in two stories with respect to this car frame (1), one end of rope (4) is fastened to car frame (1), and the other end of this rope (4) is fastened to balancing weight (6) after being hooked to drive sheave **(5*a*) of hoist (5). Main guide rails (7*a*) and (7*b*) are erected on both sides of car frame (1) and guide a car comprised of upper and lower car chambers (2) and (3) and said car frame (1)** in the vertical direction.

Figure 2:
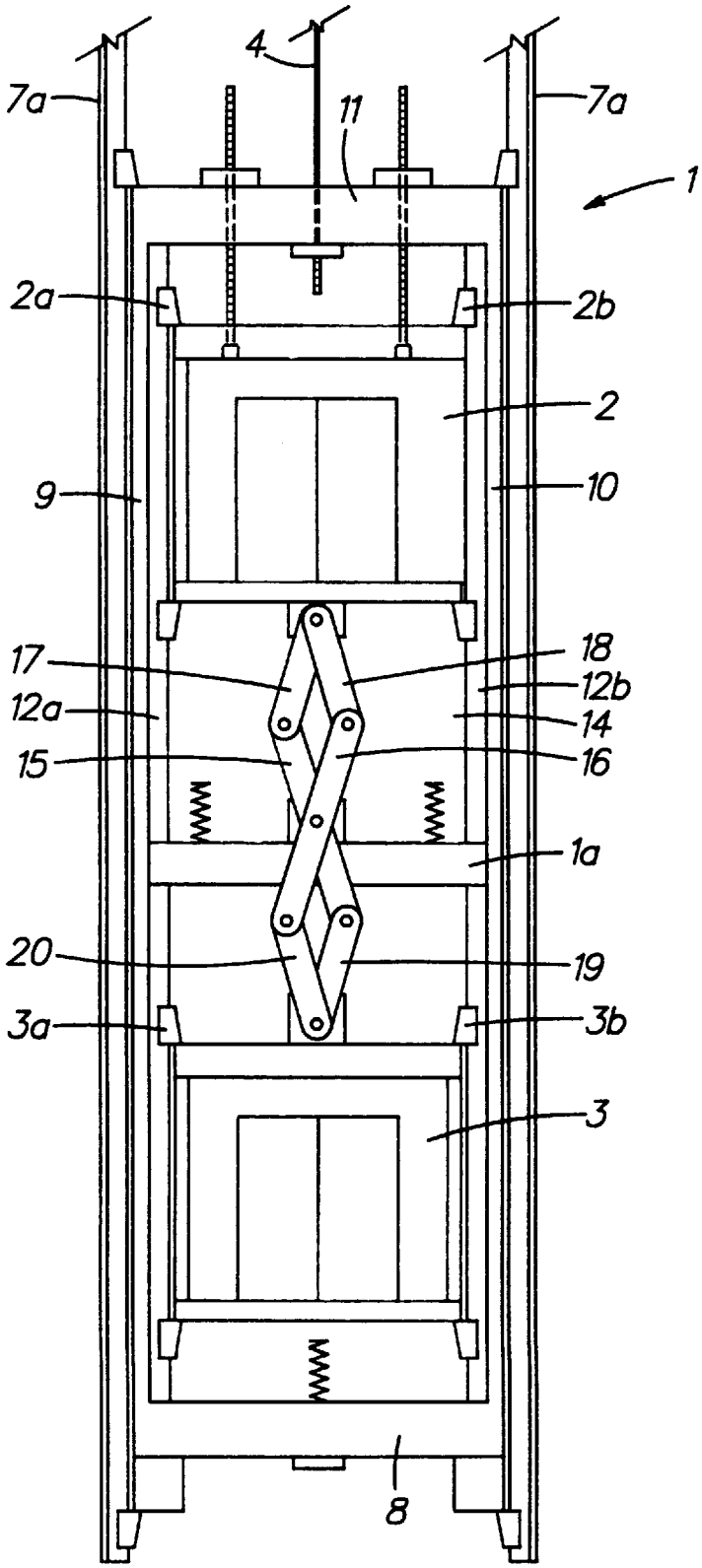
FIG. 2 is a frontal view of the upper and lower car chambers.

As shown in FIG. 2, car frame (1) is comprised of plank channel (8) on the lower side of car chambers (2) and (3), upright channels (9) and (10) on both the left and right sides, and crosshead channel (11) on the upper side. Secondary guide rails **(12*a*) and (12*b*) are provided to upright channels (9) and (10) so that car chambers (2) and (3) can be vertically moved with respect to car frame (1). Guide shoes (2*a*), (2*b*), and (3*a*), (3*b*) attached to upper and lower car chambers (2) and (3) are slidably engaged with secondary guide rails (12*a*) and (12*b*)**.

Figure 3:
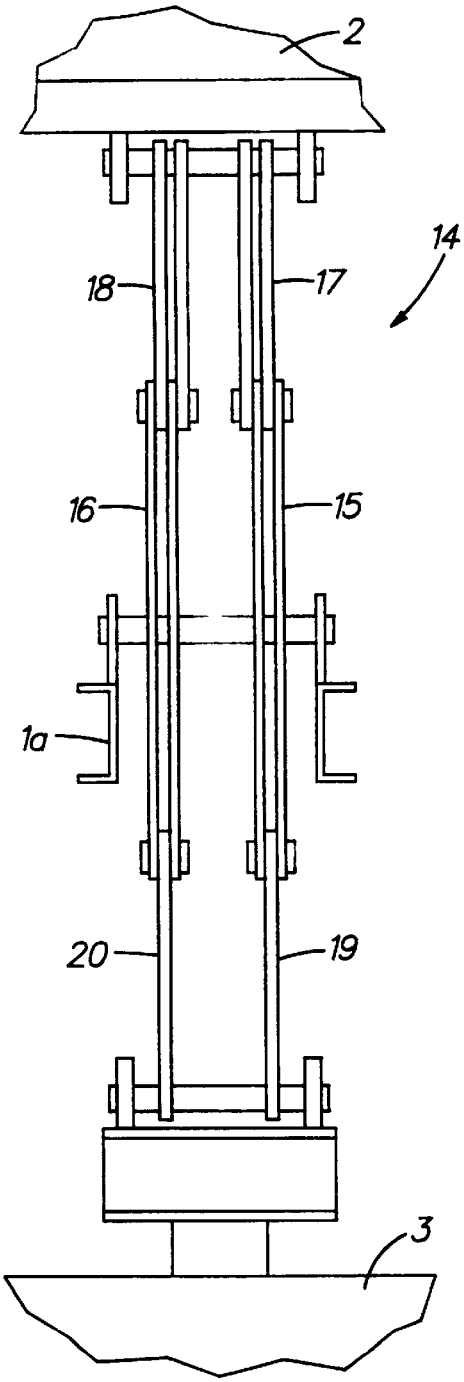
FIG. 3 is a side view of the linking mechanism.

Car frame (1) has support frame **(1*a*) at approximately the center part and linking mechanism (14) is provided for this support frame (1***a*). Linking mechanism (14) is comprised of long first and second links (15) and (16) in which approximately the center part is rotatably provided with support frame (1*a*), short third and fourth links (17) and (18) coupled to the top ends of said first and second links (15) and (16), and short fifth and sixth links (19) and (20) coupled to the bottom ends of first and second links (15) and (16) as shown in FIG. 3. The top half of first and second links (15) and (16) as well as third and fourth links (17) and (18) have a rhomboidal shape. Also, the bottom half of first and second links (15) and (16) and fifth and sixth links (19) and (20) compose a rhomboidal shape. The top ends of third and fourth links (17) and (18) are coupled to upper car chamber (2), with the bottom ends of fifth and sixth links (19) and (20) being coupled to lower car chamber (3).

Upper car chamber (2) attempts to expand the upper half of first and second links (15) and (16) with its weight and at the same time also attempts to expand the lower half. Therefore, a pull-up force acts upwards on lower car chamber (3) via linking mechanism (14) with the weight of upper car chamber (2). As a result, upper car chamber (2) and lower car chamber (3) are balanced due to the weight of upper car chamber (2) and the weight of the lower car chamber (3) being identical.

Here, as shown in FIG. 3, two links are made into a set as a buckling countermeasure since first and second links (15) and (16) as well as third and fourth links (17) and (18) are comprised by the weight of upper car chamber (2), but fifth and sixth links (19) and (20) are tensioned by lower car chamber (3), so that there can be only one link.

Figure 4:
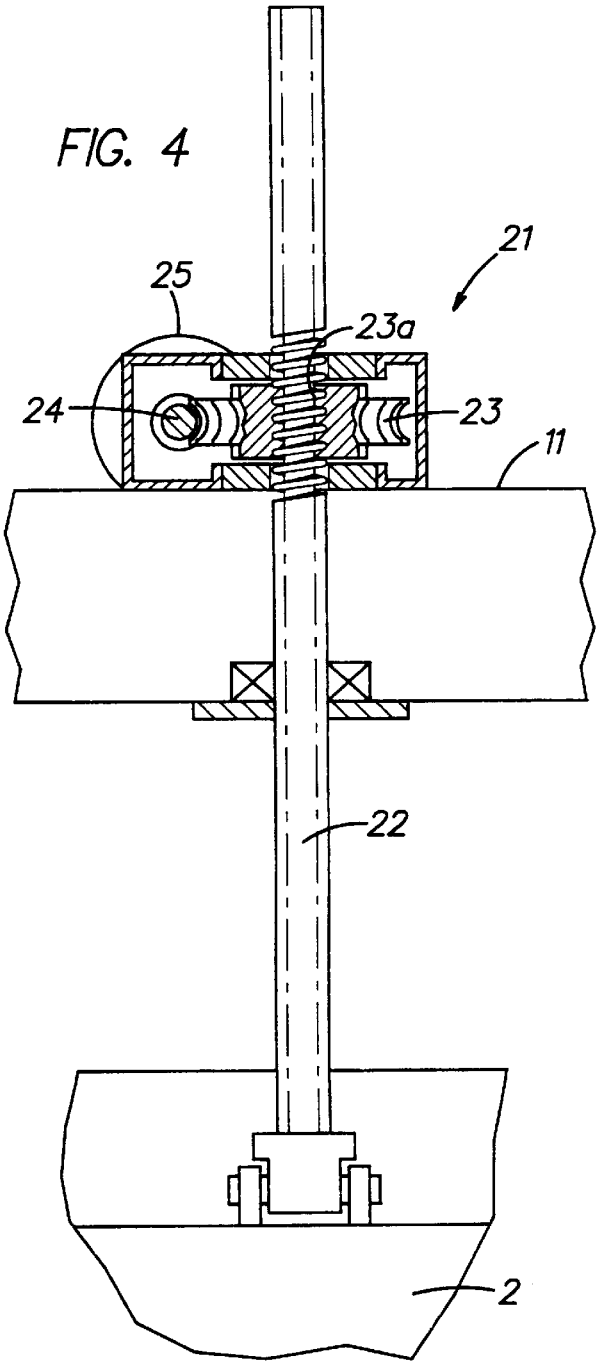
FIG. 4 is a frontal view of the driving means.

Driving means (21) for vertically moving upper car chamber (2) as shown in FIG. 4 is provided to crosshead channel (11) of car frame (1). Driving means (21) has drive shaft (22) threaded with a screw that penetrates crosshead channel (11), with the bottom end of this drive shaft (22) being coupled to upper car chamber (2). Drive shaft (22) is engaged with threaded center hole (23*a*) of worm wheel (23). This worm wheel (23) is made of plastic and has a lubricating function and abrasion resistance. Also, worm wheel (23) engages with worm shaft (24) and this worm shaft (24) is rotated by motor (25) via a reduction gear mechanism.

When motor (25) is driven, worm wheel (23) is rotated and upper car chamber (2) is vertically moved via drive shaft (22) according to the rotation of worm wheel (23). At this time, lower car chamber (3) is simultaneously moved vertically in the opposite direction from upper car chamber (2) via linking mechanism (14), and the spacing between upper and lower car chambers (2) and (3) expands or narrows. The drive force of motor (25) needs to drive only the difference between the weight of the passengers riding in upper car chamber (2) and the weight of the passengers riding in lower car chamber (3) since upper and lower car chambers (2) and (3) are balanced, so that the drive force of said motor (25) can be minimal.

Figure 5:
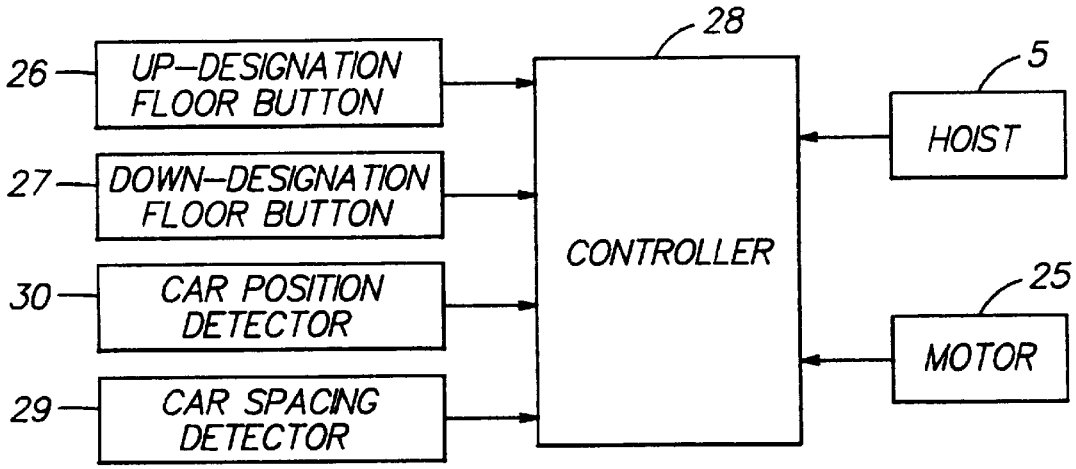
FIG. 5 is a block diagram of said variable double deck elevator.
Figure 8:
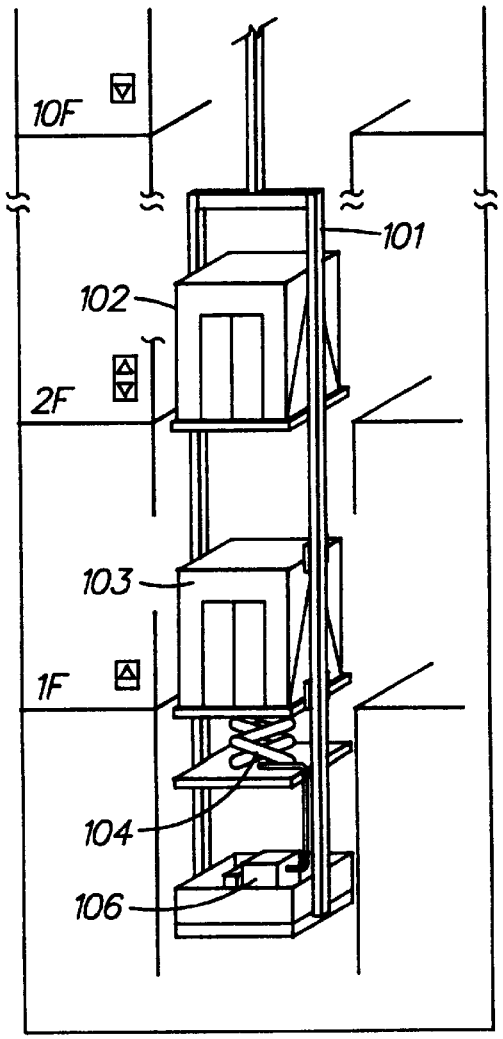
FIG. 8 PRIOR ART
FIG. 8 is a perspective view of a conventional double deck elevator.
Figure 6:
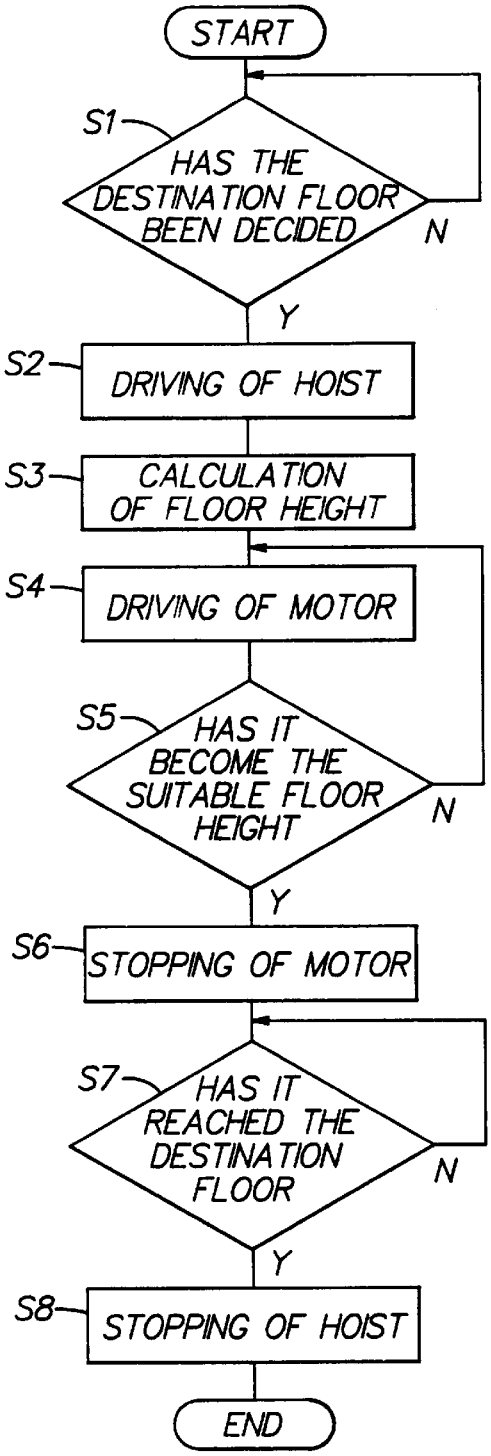
FIG. 6 is a flow chart of said variable double deck elevator.

As schematically shown in FIG. 5, up and down destination floor buttons (26) and (27) are provided to upper and lower car chambers (2) and (3), with signals being output to controller (28) provided in the machine room, etc., from up and down destination floor buttons (26) and (27). In the car-spacing memory part within controller (28), suitable spacing for upper and lower car chambers (2) and (3) complying with the height of each floor is recorded. Photoelectric car-chamber spacing detector (29) for detecting said spacing is provided to upper and lower car chambers (2) and (3) and a signal is output to controller (28) from this car-chamber spacing detector (29). Also, a signal is input to controller (28) from car position detector (30) composed of a rotary encoder provided in connection with a speed governor, etc. A signal is output from controller (28) to motor (25) of driving means (21) and hoist (5).

When the destination floor buttons (26) and (27) are pressed by the passengers riding in upper and lower car chambers (2) and (3), signals are output to controller (28) from said destination floor buttons (26) and (27) (Step $S_1$). A signal is output to hoist (5) from controller (28), with upper and lower car chambers (2) and (3) travelling towards the destination floor (Step $S_2$).

Controller (28) calculates the suitable spacing between upper and lower car chambers (2) and (3) at the destination floor (Step $S_3$). Motor (25) is driven according to said calculated suitable spacing (Step $S_4$). At this time, upper and lower car chambers (2) and (3) can be moved simultaneously via linking mechanism (14), so an adjustment in the spacing of said car chambers (2) and (3) can be quickly executed. Whether upper and lower car chambers (2) and (3) are in a suitable spacing is detected with car spacing detector (29) (Step $S_5$). If the spacing of upper and lower car chambers (2) and (3) is suitable, motor (25) is stopped (Step $S_6$).

Whether upper and lower car chambers (2) and (3) have reached the destination floor is detected with car position detector (30) (Step $S_7$); if it has been reached, the driving of hoist (5) is stopped (Step $S_8$).

Figure 7:
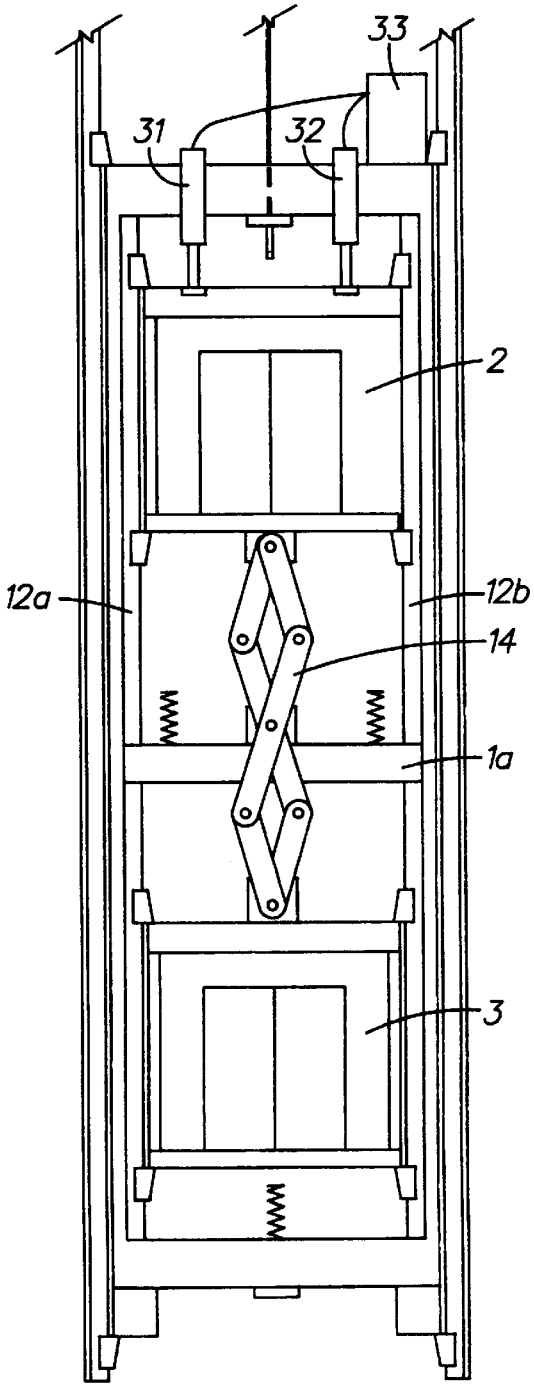
FIG. 7 is a frontal view of another application example.
Figure 9:
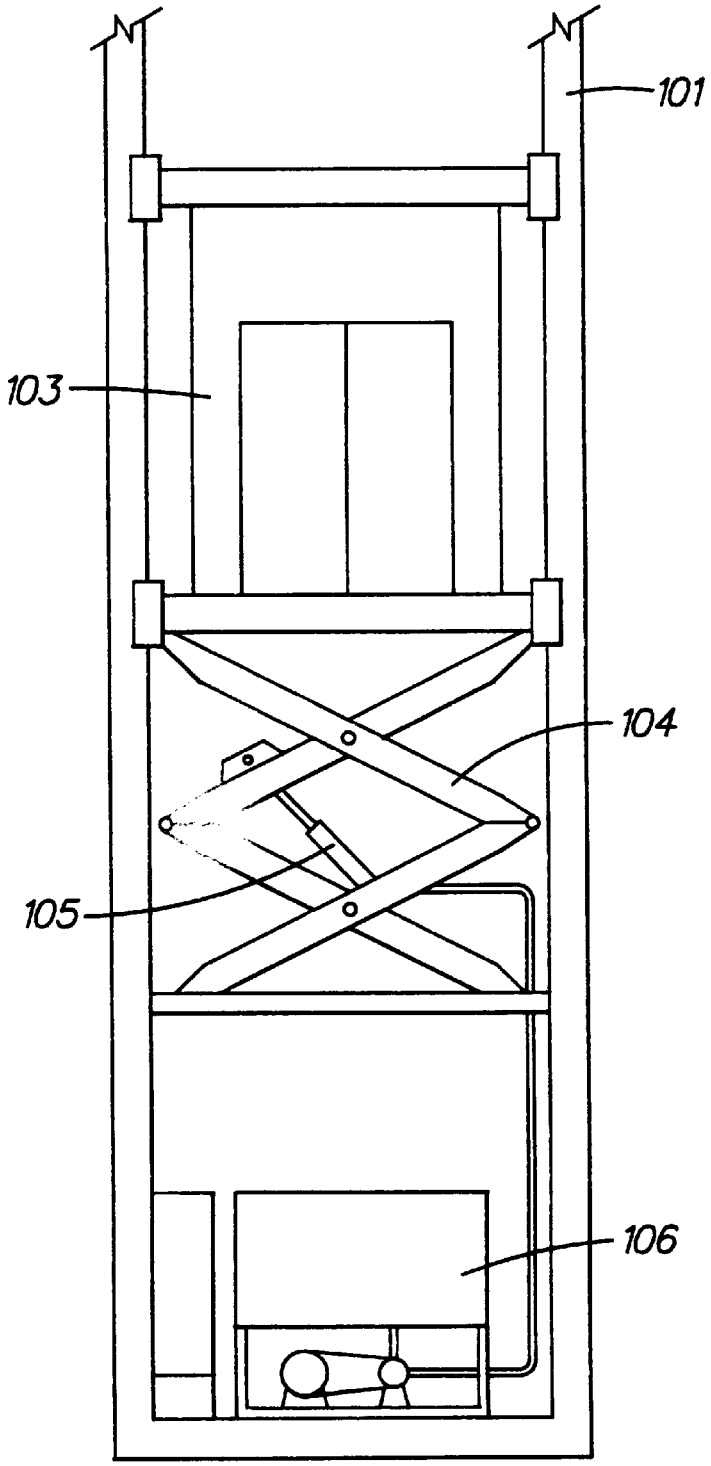
FIG. 9 PRIOR ART
FIG. 9 is a frontal view of a conventional lower car chamber.

Next, another application example of the present invention is shown in FIG. 7. In this application example, the driving means for vertically moving the upper car chamber is composed of oil pressure cylinders (31) and (32), oil pressure unit (33), etc. In addition, the driving means can be composed of a linear motor, etc.

As explained above, according to the present invention, a linking mechanism is interposed between the upper car chamber and the lower car chamber, so adjustment in the spacing between the upper and lower car chambers can be quickly executed. Also, the upper car chamber and lower car chamber are balanced so the drive force of the driving means can be minimal and reduction in the cost can be achieved. In addition, the driving means can be made compact and light; as a result, it is possible to reduce the running cost of the elevator.

Although the invention has been described and illustrated with respect to exemplary embodiments thereof, it should be understood by those skilled in the art that the foregoing, and various other changes, omissions and additions may be made without departing from the spirit and scope of the present invention.

What is claimed is:

1. A variable double deck elevator comprising:

a first car a second car a car frame aligning the first and second cars in a vertically superimposed relationship, a linking mechanism linking the first and second cars for positioning each car vertically relative to the other car, wherein the linking mechanism comprises, a first link and a second link in which approximately the center part is rotatably coupled to the car frame, a third link and a fourth link respectively coupled to the top ends of said first link and second link, and a fifth link and a sixth link respectively coupled to the bottom ends of said first link and second link, with the top ends of said third link and fourth link being coupled to the upper car and with the bottom ends of said fifth link and sixth link being coupled to the lower car;

the first car exerts a first downward force on the linking mechanism, the second car exerts a second downward force on the linking mechanism, and the linking mechanism balances the first and second forces each against the other.

2. The elevator as recited in claim 1, further comprising:

driving means for vertically moving one of the cars vertically with respect to the car frame.

3. The elevator as recited in claim 2, wherein the driving means includes a drive shaft, including a threaded screw, extending between the one car and the car frame, a threaded link, disposed in a worm wheel, for receiving the threaded screw, a worm shaft, engaged with the worm wheel, and a drive motor for selectively rotating the worm shaft.

4. The elevator as recited in claim 2, wherein the driving means includes an hydraulic cylinder.

5. The elevator as recited in claim 2, wherein the driving means includes a linear electric motor.

* * * * *